US009122179B2

(12) United States Patent
Schneider et al.

(10) Patent No.: US 9,122,179 B2
(45) Date of Patent: Sep. 1, 2015

(54) TONER PROCESS COMPRISING REDUCED COALESCENCE TEMPERATURE

(71) Applicant: XEROX CORPORATION, Norwalk, CT (US)

(72) Inventors: Jay Lee Schneider, Canandaigua, NY (US); Abdisamed Sheik-Qasim, Etobicoke (CA); Randy Pheav Tin, Webster, NY (US); Christopher Michael Wolfe, Rochester, NY (US); Richard Philip Nelson Veregin, Mississauga (CA); Mark Elliott, Burlington (CA); Melanie Davis, Hamilton (CA); Cuong Vong, Hamilton (CA); Shigang Steven Qiu, Toronto (CA)

(73) Assignee: XEROX CORPORATION, Norwalk, CT (US)

( * ) Notice: Subject to any disclaimer, the term of this patent is extended or adjusted under 35 U.S.C. 154(b) by 73 days.

(21) Appl. No.: 13/972,360

(22) Filed: Aug. 21, 2013

(65) Prior Publication Data

US 2015/0056551 A1 Feb. 26, 2015

(51) Int. Cl.
*G03G 9/08* (2006.01)

(52) U.S. Cl.
CPC ..... *G03G 9/0804* (2013.01); *G03G 9/081* (2013.01)

(58) Field of Classification Search
CPC ..... G03G 9/0804
USPC ..... 430/137.14
See application file for complete search history.

(56) References Cited

U.S. PATENT DOCUMENTS

| | | | | |
|---|---|---|---|---|
| 3,590,000 | A | 6/1971 | Palermiti | |
| 3,655,374 | A | 4/1972 | Palermiti | |
| 3,674,736 | A | 7/1972 | Lerman | |
| 3,720,617 | A | 3/1973 | Chatterji | |
| 3,944,493 | A | 3/1976 | Jadwin | |
| 3,983,045 | A | 9/1976 | Jugle | |
| 4,007,293 | A | 2/1977 | Mincer | |
| 4,079,014 | A | 3/1978 | Burness | |
| 4,298,672 | A | 11/1981 | Lu | |
| 4,338,390 | A | 7/1982 | Lu | |
| 4,394,430 | A | 7/1983 | Jadwin | |
| 4,560,635 | A | 12/1985 | Hoffend | |
| 5,290,654 | A | 3/1994 | Sacripante | |
| 6,004,714 | A | 12/1999 | Ciccarelli | |
| 6,063,827 | A | 5/2000 | Sacripante | |
| 6,447,974 | B1 | 9/2002 | Chen | |
| 6,576,389 | B2 | 6/2003 | Vanbesien | |
| 6,593,049 | B1 | 7/2003 | Veregin | |
| 6,617,092 | B1 | 9/2003 | Patel | |
| 6,664,017 | B1 | 12/2003 | Patel | |
| 6,756,176 | B2 | 6/2004 | Stegamat | |
| 6,830,860 | B2 | 12/2004 | Sacripante | |
| 7,749,672 | B2 | 7/2010 | Farrugia | |
| 7,754,406 | B2 | 7/2010 | Vanbesien | |
| 7,781,138 | B2 | 8/2010 | Sacripante | |
| 8,691,488 | B2 * | 4/2014 | Davis et al. | 430/137.14 |
| 2006/0222991 | A1 | 10/2006 | Sacripante | |
| 2012/0258392 | A1 * | 10/2012 | Murata et al. | 430/105 |

FOREIGN PATENT DOCUMENTS

WO WO-2011-074674 * 6/2011

* cited by examiner

*Primary Examiner* — Janis L Dote

(74) *Attorney, Agent, or Firm* — Pillsbury Winthrop Shaw Pittman LLP

(57) ABSTRACT

A method of forming toner particles includes aggregating a mixture of a latex, a wax, and an optional pigment to form pre-toner particles, and coalescing the pre-toner particles at a substantially constant target temperature selected within a range from about the glass transition temperature of the pre-toner particles to about 75° C., thereby creating toner particles having a substantially constant particle size distribution during the coalescing step.

17 Claims, 2 Drawing Sheets

TONER PROCESS COMPRISING REDUCED COALESCENCE TEMPERATURE

BACKGROUND

Embodiments disclosed herein relate to processes for the preparation of toner particles. More particularly, embodiments disclosed herein relate to processes that control the coalescence of latex particles in the formation of toner particles.

High temperatures (about 80° C. or more) drive the coalescence of aggregated latex particles into contiguous toner particles in conventional aggregation/coalescence processes. However, employing high temperatures may be energy intensive, lead to long temperature ramp-up times following aggregation, and may cause excessive fouling in reactors and pH systems. Aggressive cleaning of all processing equipment and pH systems may be required due to such fouling. Moreover, high coalescence temperatures can also cause coarse particle growth, a problem that can be exacerbated by temperature spikes from the heating jacket in conventional cascade controlled heating systems.

Cascade controlled heating typically involves the direct monitoring of reaction temperature in conjunction with a feedback temperature controller used to adjust the temperature of a heating element, such as a heating jacket, to meet the demands of the targeted reaction temperature. Temperature spikes may arise when the feedback controller adjusts the power to the heating element in response to a need for the reaction mixture to be increased up to the target temperature. A nominal delay in attaining the requisite reaction temperature, or other circumstances, may cause the feedback controller to signal the need for more heat, ultimately overheating the heating element and causing the reaction temperature to overshoot the target temperature.

SUMMARY

A method of forming toner particles comprising aggregating a mixture comprising a latex, a wax, and an optional pigment to form pre-toner particles; and coalescing the pre-toner particles at a substantially constant target temperature selected within a range from about the glass transition temperature of the pre-toner particles to about 75° C., thereby creating toner particles having a substantially constant particle size distribution during the coalescing step.

A method of forming toner particles comprising aggregating a latex, a wax, and a colorant to form pre-toner particles; and coalescing the pre-toner particles at a substantially constant target temperature in a range from about the glass transition temperature of the pre-toner particles to about 75° C., thereby creating toner particles, wherein the toner particles exhibit reduced coarse particle formation during the coalescing step and have a substantially constant $D_{50}$-$D_{84}$ ratio over the period of coalescence.

A method comprising aggregating a latex, a wax, and a colorant to form pre-toner particles; and coalescing the pre-toner particles at a substantially constant target temperature in a range from about the glass transition temperature of the pre-toner particles to about 75° C., thereby creating toner particles, wherein the toner particles are hyperpigmented and exhibit a dielectric loss of less than about 60 J/s.

DETAILED DESCRIPTION

Typical toner particle coalescence processes are performed at about 85° C. with cycle times varying from about one to about five hours for all color types. Processes disclosed herein employ two approaches that may improve toner particle performance and production cycle time at the coalescence stage by (1) lowering the coalescence temperature and (2) providing tighter temperature control by avoiding cascade type control. While lower temperatures may slightly increase the coalescence time, the lost time may be compensated for by a reduced ramping time to reach the lower coalescence temperature following aggregation, which may result in an overall decrease in cycle time from temperature ramp-up through the end of coalescence.

Figure 1:
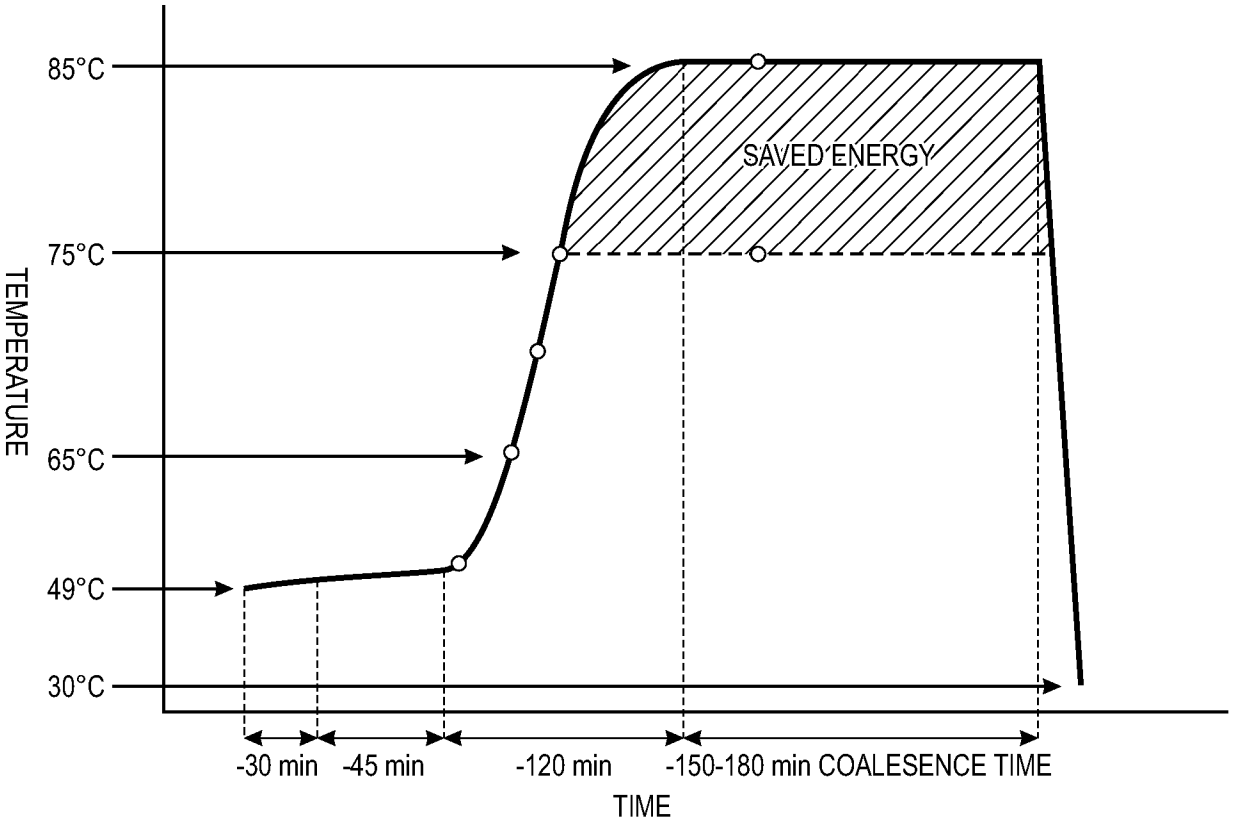
FIG. 1 shows a temperature versus time graph for toner manufacturing with a target coalescence temperature of about 85° C., with a dashed line indicating an exemplary lower target temperature in accordance with embodiments disclosed herein.

An exemplary time-course plot of temperature for a conventional toner manufacturing process through coalescence is shown in FIG. 1 with a target coalescence temperature of about 85° C. As can be seen in FIG. 1, the last hour of the two hours for the ramp up to coalescence temperature is the time it takes to increase the temperature from 75° C. to 85° C. The temperature ramp itself does not provide functionality in the toner production process and represents recoverable time for performing coalescence at a lower temperature. In accordance with an exemplary embodiment, the dashed line at about 75° C. in FIG. 1 indicates that an hour of time for ramp-up to 85° C. can be saved by targeting a lower coalescence temperature potentially reducing the overall cycle time, depending on the increased amount of time needed for coalescence at the lower temperature. Reducing the coalescence temperature may also reduce the energy required for each batch which can provide environmental benefits while minimizing energy costs.

In particular embodiments, through the use of jacket-controlled heating, methods disclosed herein may reduce occurrences of temperature spikes, which helps keep coarse growth under control. Other methods for maintaining substantially constant temperatures and avoiding temperature spikes will be apparent to those skilled in the art. As an added benefit, processes disclosed herein may provide toner products with reduced dielectric loss, which is important to reduce inductive charging which can lead to loss of transfer efficiency and higher background on the prints.

Thus, embodiments disclosed herein provide methods of forming toner particles comprising aggregating a mixture comprising a latex and a wax to form pre-toner particles, and coalescing the pre-toner particles at a substantially constant target temperature in a range from about the glass transition temperature of the particles of the latex to about 75° C., thereby creating toner particles, wherein the toner particles have a substantially constant particle size distribution over the course of the coalescing step.

Figure 2:
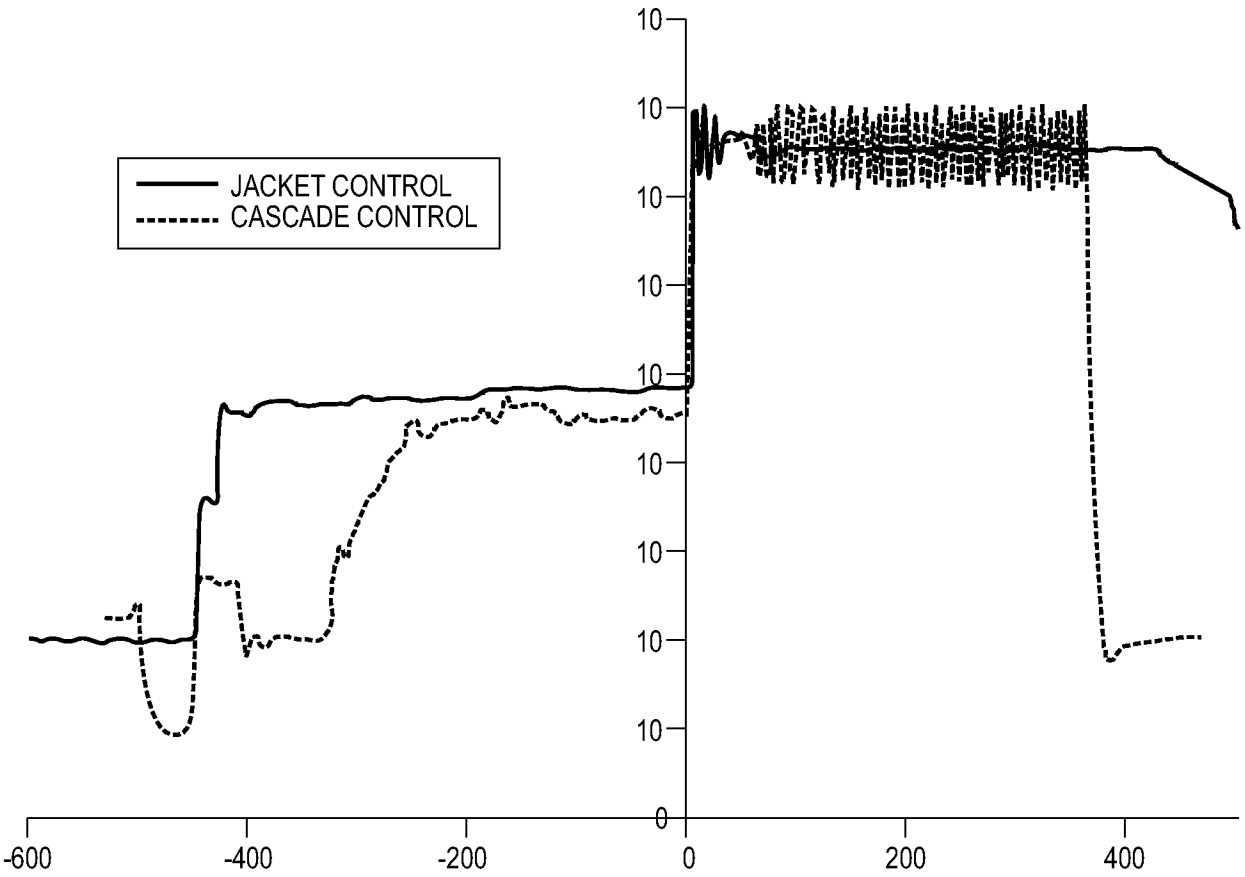
FIG. 2 shows a graph indicating jacket temperature volatility of cascade versus direct jacket-controlled heating. X-axis is time in minutes, Y-axis is temperature in ° C.

In particular embodiments, the substantially constant target temperature is maintained via direct jacket-controlled heating. As used herein, "substantially constant target temperature" means that the heating method avoids the temperature spikes associated with conventional heating systems, such as cascade heating systems. See for example, FIG. 2 where the dashed line indicates an oscillation in temperature over the coalescence period at about 75° C. when employing cascade controlled heating. In embodiments, "substantially constant target temperature" refers to maintaining a target temperature to within about plus or minus 0.2° C.

As used herein, "pre-toner particles," generally refers to the initial mass of aggregated particles of a latex, along with any additives, as part of an aggregation coalescence process. That is, the pre-toner particles represent the product after aggregation before coalescence.

As used herein, "target temperature" generally refers to the temperature at which the coalescence step is to be performed. In embodiments, the target temperature can be any temperature at which coalescence occurs while being lower than conventional coalescence temperatures. In some embodiments, the target temperature may be about 5° C., or about 10° C., or about 15° C. less than a conventional toner coalescence temperature. One skilled in the art will recognize that the exact choice of target temperature may depend on, inter alia, the exact composition of the latex employed. In an exemplary embodiment, the target temperature may be about 75° C. for a typical polyester latex, although the temperature may be anywhere from about the glass transition temperature of the latex particles up to about 75° C. In some embodiments, the target temperature may be at least about 5° C., or about 10° C., or about 15° C. greater than the glass transition temperature of the latex particles. An exact choice of temperature above the glass transition temperature may be selected based on a balance of cost-benefit analysis of the energy savings of running at lower temperature versus the increase in time required to complete coalescence.

As used herein, "latex" generally refers to a liquid having polymeric resin particles dispersed therein. Latexes may be prepared directly from emulsion polymerization reactions, such as acrylate-styrene copolymers, or may be formed via phase inversion emulsification, such as with polyester-based resins.

As used herein, "coalescing" or "coalescence," generally refers to the later part of aggregation-coalescence process in the formation of toner particles. In embodiments, coalescence may involve achieving desired particle dimensions, such as particle size and circularity.

As used herein, "glass transition temperature," has its ordinary meaning which is the temperature of reversible transition in amorphous materials, or in amorphous regions within semi-crystalline materials, from a hard and relatively brittle state into a molten state.

As used herein, "jacket-controlled heating," refers to the direct control of jacket temperature to modulate the temperature of a reaction mixture. In practice, the heating jacket is operated independently from a feedback temperature controller. In this manner a fixed jacket temperature is selected, while reaction temperature may be separately monitored. In embodiments, a jacket temperature may be initially selected at slightly higher than the target temperature and when the target temperature is reached, the jacket temperature may be lowered to meet the target temperature. This may allow for smooth temperature control while avoiding undesirable temperature spikes.

As used herein, a "substantially constant particle size distribution" means that at least the mean particle size and outlier particle sizes remain in substantially the same proportions during the course of coalescence. This ability to tightly control particle size reflects the absence of temperature spikes by providing a substantially constant temperature. In embodiments, a substantially constant particle size distribution can be expressed by a substantially constant $D_{50}$-$D_{84}$ ratio.

In emulsion aggregation processes, the reactants may be added to a suitable reactor, such as a mixing vessel. A blend of latex, optional colorant dispersion, wax, and aggregating agent, may then be stirred and heated to a temperature near the $T_g$ of the latex, in embodiments from about 30° C. to about 70° C., in embodiments from about 40° C. to about 65° C., resulting in pre-toner particles as aggregates from about 3 microns to about 15 microns in volume average diameter, in embodiments of from about 5 microns to about 9 microns in volume average diameter. In some embodiments, the pre-toner particles may be smaller for the production of super-fine toners.

In embodiments, methods may further comprise adding a shell latex to the pre-toner particles before or during the coalescing step. Any latex used for the core may be also utilized to form the shell latex. In embodiments, a polyester or styrene-acrylate copolymer may be utilized to form the shell latex. In embodiments, the latex utilized to form the shell may have a glass transition temperature from about 35° C. to about 75° C., in embodiments from about 40° C. to about 70° C. In embodiments, a shell may be formed on the pre-toner particles including a blend of a first latex for the core and a second latex for the shell. In embodiments, a shell or core latex, or both may incorporate a charge control agent, as further described below.

Where present, a shell latex may be applied by any method within the purview of those skilled in the art, including dipping, spraying, or during coalescence. The shell latex may be applied until the desired final size of the toner particles is achieved, in embodiments from about 3 microns to about 12 microns, in other embodiments from about 4 microns to about 8 microns. In other embodiments, the toner particles may be prepared by in-situ seeded semi-continuous emulsion copolymerization of the latex with the addition of the shell latex once aggregated particles have formed.

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Any aggregating agent capable of causing complexation might be used in forming toner particles. Alkali earth metal and/or transition metal salts can be utilized as aggregating agents. In embodiments, alkali (II) salts can be selected to aggregate sodium sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like. The resulting blend of latex, optionally in a dispersion, CCA, optionally in dispersion, optional colorant dispersion, optional wax, optional coagulant, and optional aggregating agent, may then be stirred and heated to a temperature below the Tg of the latex, in embodiments from about 30° C. to about 70° C., in embodiments of from about 40° C. to about 65° C., for a period of time from about 0.2 hours to about 6 hours, in embodiments from about 0.3 hours to about 5 hours, resulting in toner aggregates of from about 3 microns to about 15 microns in volume average diameter, in embodiments of from about 4 microns to about 8 microns in volume average diameter.

Once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The mixture of latex, optional latex incorporated with a CCA, optional colorant, and optional wax may be subsequently coalesced in accordance with embodiments disclosed herein. In embodiments, coalescence temperatures may be set at a target temperature of no more than about 75° C. For example, a typical low-melt polyester may be one such system in which the temperature of coalescence may be conducted at or below about 75° C. Coalescing may heating above this temperature, including from about 80° C. to about 99° C., in embodiments from about 85° C. to about 98° C., for a period of from about 0.5 hours to about 12 hours, and in embodiments from about 1 hour to about 6 hours. Any target temperature above 75° C. may be selected with the proviso that such a target temperature is lower than what would normally be employed in coalescence of the particular latex. In some such embodiments, the target temperature may be at least 5, 10, or 15° C. lower than conventional coalescence temperatures. Examples of latexes that might have target temperatures above 75° C., include, for example styrene-based latexes. Coalescing may be accelerated by additional stirring.

Coalescence via jacket-controlled heating may be accomplished by selecting a fixed jacket temperature which may be the target temperature, or about 5 to about 10 degrees above the target temperature. As the temperature approaches the target temperature, the jacket temperature may be adjusted down to the target temperature. In some embodiments, the jacket temperature may be pre-equilibrated prior to subjecting the aggregated pre-toner particles to the target temperature. In some embodiments, cascade type control may be employed up until about 5 to about 10° C. below the target temperature and then the temperature can be switched to jacket control. In embodiments, jacket control ramping to the target temperature may be carried out followed by maintaining of the target temperature by cascade control only after the target temperature has been reached. In embodiments, where a sufficiently low target temperature is employed one may employ cascade control, provided that any temperature spikes do not negatively impact particle characteristics, such as size distribution. Otherwise, complete jacket control may be used, as indicated above.

In embodiments, methods disclosed herein may provide a combined time to ramp up to the target temperature plus complete the coalescing step that is reduced relative to a combined time to ramp up to about 85° C. plus the time complete the coalescing step. In embodiments, a combined time to ramp up to about 85° C. plus the time complete the coalescing step represents a typical low-melt polyester for which the present methods perform coalescence at or below about 75° C. As described herein, the reduced coalescence temperature, while nominally increasing coalescence times in most circumstances, can reduce the time it takes to ramp up to the coalescence temperature. Thus, the overall cycle time from ramp-up to the target temperature through the end of coalescence can actually be shorter at the lower temperature.

After coalescence, the pH of the mixture may then be lowered to from about 3.5 to about 6, in embodiments from about 3.7 to about 5.5, with, for example, an acid to coalesce the toner aggregates. Suitable acids include, for example, nitric acid, sulfuric acid, hydrochloric acid, citric acid or acetic acid. The amount of acid added may be from about 0.1 to about 30 percent by weight of the mixture, and in embodiments from about 1 to about 20 percent by weight of the mixture.

The mixture is cooled in a cooling or freezing step. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling medium such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may be implemented by the introduction of a heat exchanger when the final toner slurry is discharged.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 67° C. The washing may include filtering and re-slurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45°

C. to about 60° C. The drying may be continued until the moisture level of the particles is below a set target of about 1% by weight, in embodiments of less than about 0.7% by weight.

Toner particles may possess a CCA, in embodiments a CCA incorporated into a latex, in amounts of from about 0.01 percent by weight to about 10 percent by weight of the toner particles, in embodiments from about 0.1 percent by weight to about 8 percent by weight of the toner particles. As noted above, the toner particles may possess CCA latex in the core, shell, or a combination of both. When in a combination of core and shell, the ratio of CCA latex in the core to the shell may be from about 1:99 to about 99:1, and all combinations in between. In embodiments, toners of the present disclosure possessing a CCA that has been added during the EA process as a dispersion may have a triboelectric charge of from about −2 μC/g to about −60 μC/g, in embodiments from about −10 μC/g to about −40 μC/g. Toners of the present disclosure may also possess a parent toner charge per mass ratio (Q/M) of from about −3 μC/g to about −35 μC/g, and a final toner charging after surface additive blending of from −10 μC/g to about −45 μC/g.

In embodiments, the toner particles formed by the methods disclosed herein may have the following properties" (1) Volume average diameter (also referred to as "volume average particle diameter") from about 3 to about 25 μm, or from about 4 to about 15 μm, or from about 4.5 to about 10 μm; (2) Number Average Geometric Size Distribution (GSDn) and/or Volume Average Geometric Size Distribution (GSDv) from about 1.05 to about 1.55, such as from about 1.1 to about 1.4, from about 1.15 to about 1.35, or from about 1.20 to about 1.30; (3) Circularity from about 0.93 to about 1, such as from about 0.94 to about 0.99, from about 0.95 to about 0.98, or from about 0.96 to about 0.97; and (4) Coarse content of from about 0.01% to about 10%, such as from about 0.1% to about 5%, from about 0.3% to about 3%, or from about 0.5% to about 2%.

The characteristics of the toner particles may be determined by any suitable technique and apparatus. Methods disclosed herein may provide toner particles which exhibit reduced coarse particle formation during the coalescing step as indicated by a substantially constant $D_{50}$-$D_{84}$ ratio over the period of coalescence. Volume average particle diameter $D_{50}$v, GSDv, and GSDn may be measured by means of a measuring instrument such as a Beckman Coulter Multisizer 3, operated in accordance with the manufacturer's instructions. The GSDv refers to the upper geometric standard deviation (GSDv) by volume (coarse level) for (D84/D50). The GSDn refers to the geometric standard deviation (GSDn) by number (fines level) for (D50/D16). The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution.

Representative sampling may occur as follows: a small amount of toner sample, about 1 g, may be obtained and filtered through a 25 μm screen, then put in isotonic solution to obtain a concentration of about 10%, with the sample then run in a Beckman Coulter Multisizer 3.

The circularity of the toner particles may be determined by any suitable technique and apparatus. The circularity is a measure of the particles closeness to perfectly spherical. A circularity of 1.0 identifies a particle having the shape of a perfect circular sphere. Volume average circularity may be measured by means of a measuring instrument such as a Flow Particle Image Analysis (FPIA) such as for example the Sysmex® Flow Particle Image Analyzer, commercially available from Sysmex Corporation, operated in accordance with the manufacturer's instructions. Representative sampling may occur as follows: about 0.5 g of toner sample may be obtained and filtered through a 25 μm screen, then put in deionized water to obtain a concentration of about 5%, with the sample then run in a Flow Particle Image Analyzer.

The coarse content of the toner particles may be determined by any suitable technique and apparatus. Coarse content may be measured by means of wet sieving using a sieve and collecting the coarse or a measuring instrument such as a coulter counter, such as the Beckman Coulter Counter Multisizer 3, commercially available from Beckman Coulter, operated in accordance with the manufacturer's instructions. Representative sampling may occur as follows: a small amount of toner sample, about 1 g, may be obtained and filtered through a 25 μm screen, then put in isotonic solution to obtain a concentration of about 10%, with the sample then run in a Beckman Coulter Multisizer 3.

Furthermore, methods disclosed herein may provide toner particles which exhibit a dielectric loss of less than about 60 J/s (watts). In embodiments, dielectric loss may be less than about 50 J/s. In embodiments, a toner made by methods disclosed herein may be characterized by a dielectric loss, calculated as known in the art or as taught herein, of from about 30 to about 70 J/s, from about 40 to about 60 J/s, from about 40 to about 50 J/s, and so on. In embodiments, the reduction in dielectric loss is less than about 60 J/s, less than about 55 J/s, less than about 50 J/s. Methods disclosed herein may employ reduced coalescence temperatures in conjunction with a rapid or quench cooling of the emulsion following coalescence, which can reduce toner dielectric loss by at least about 60%, at least about 50%, at least about 40%, at least about 30% as compared to toner produced using a coalescence target temperature greater than the melting point of, for example, a crystalline resin and a wax, when present. Again, while not being bound by theory, by reducing Tc, by quench cooling or both, the flow of resins and wax in the toner may be reduced and thus, pigment may be restricted from moving and pooling together, such as, at or near the surface of the particles thereby creating domains that are conductive, where such conductive domains may explain why the dielectric loss is higher. Thus, toners disclosed herein may be made with higher pigment loading (e.g., hyperpigmented toners) and shell loading, and with reduced dielectric loss, approaching that of non-hyperpigmented toners.

Dielectric loss can be determined by creating a toner pellet and placing it in a mold with a spring-loaded 2-in diameter precision-ground plunger which is pressed at about 2000 psi for 2 minutes. While maintaining contact with the plunger (which acts as one electrode), the pellet can then be forced out of the mold onto a spring-loaded support, which keeps the pellet under pressure and also acts as the counter electrode. Using an HP4263B LCR Meter via shielded 1 meter BNC cables, dielectric and dielectric loss can be determined by measuring the capacitance (Cp) and the loss factor (D) at 100 KHz frequency and 1 VAC. The dielectric constant can be calculated as: $E'=[Cp(pF)\times Thickness(mm)]/[8.854\times A_{effective}(m)]$. The value, 8.854, is the vacuum electrical permittivity, epsilon(s), but in units that take into account that Cp is in picofarads, not farads, and thickness is in mm and not in meters. $A_{effective}$ is the effective area of the sample. Dielectric loss is equal to E* Dissipation factor, which is how much electrical dissipation there is in the sample, that is, how leaky the capacitor is. That is multiplied by 1000 to simplify the values. Thus, a reported dielectric loss value of 70 indicates a measured dielectric loss of $70\times10^{-3}$, or 0.070.

In embodiments, there are provided methods comprising forming pre-toner particles by aggregating a latex, a wax, and a colorant, and coalescing the pre-toner particles at a target temperature in a range from about the glass transition temperature of the aggregated latex particles up to about 75° C., thereby creating toner particles, wherein the toner particles exhibit reduced coarse particle formation during the coalescing step as indicated by a substantially constant D50-D84 ratio over the period of coalescence. In some such embodiments, the methods may further comprise adding a shell latex to the pre-toner particles during the coalescing step.

In embodiments, there are provided methods comprising forming pre-toner particles by aggregating a latex, a wax, and a colorant, and coalescing the pre-toner particles at a target temperature in a range from about the glass transition temperature of the aggregated latex particles up to about 75° C., thereby creating toner particles, wherein the toner particles are hyperpigmented and exhibit a dielectric loss of less than about 60.

Resins

Toner particles may comprise a polymer resin such as a polyester resin made from monomers suitable for use in forming a particulate containing or carrying a colorant of a toner for use in certain imaging devices. As known in the art, a range of monomers are known for producing toner particles. While the following discussion relates primarily to polyester polymers, the methods of interest can be applied to any resin made by any method where there is a final steps to finish particles to the desired parameters is a design choice.

Generally, any suitable monomer or monomers may be polymerized to form a polyester resin or a copolymer. Any polyfunctional monomer may be used depending on the particular polyester polymer desired in a toner particle. Hence, bifunctional reagents, trifunctional reagents and so on can be used. One or more reagents that comprise at least three functional groups can be incorporated into a polymer or into a branch to enable branching, further branching and/or crosslinking. Examples of such polyfunctional monomers include 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane and 1,2,7,8-octanetetracarboxylic acid. Polyester resins, for example, can be used for applications requiring low melting temperature.

One, two or more polymers may be used in forming a toner or toner particle. In embodiments where two or more polymers are used, the polymers may be in any suitable ratio (e.g., weight ratio) such as, for instance, with two different polymers, from about 1% (first polymer)/99% (second polymer) to about 99% (first polymer)/1% (second polymer), in embodiments from about 10% (first polymer)/90% (second polymer) to about 90% (first polymer)/10% (second polymer), equal amounts of both and so on, as a design choice.

In embodiments, a toner may comprise two or more amorphous polyester resins. In embodiments, a toner can comprise a crystalline polyester resin. In embodiments, a toner comprises two or more amorphous resins and a crystalline resin.

In embodiments where a toner comprises, for example, two amorphous resins and a crystalline resin, the weight ratio of the three resins may be from about 20% of a first amorphous resin/70% of a second amorphous resin/10% of a crystalline resin, to about 60% of a first amorphous resin/20% of a second amorphous resin/20% of a crystalline resin.

In embodiments, when two amorphous polyester resins are utilized, one of the amorphous polyester resins may be of high molecular weight and the second amorphous polyester resin may be of low molecular weight. As used herein, a high molecular weight amorphous resin may have, for example, a weight average molecular weight (MW) greater than about 55,000, for example, from about 55,000 to about 150,000, in embodiments, from about 50,000 to about 100,000, in embodiments, from about 60,000 to about 95,000, in embodiments, from about 70,000 to about 85,000, as determined by gel permeation chromatography (GPC), using polystyrene standards.

A high molecular weight amorphous polyester resin may have an acid value of from about 8 to about 20 mg KOH/grams, in embodiments, from about 9 to about 16 mg KOH/grams, in embodiments, from about 11 to about 15 mg KOH/grams. The high molecular weight amorphous polyester resin, which are available from a number of commercial sources, can possess various melting points of, for example, from about 30° C. to about 140° C., in embodiments, from about 75° C. to about 130° C., in embodiments, from about 100° C. to about 125° C., in embodiments, from about 115° C. to about 121° C.

A low molecular weight amorphous polyester resin has, for example, an MW of 50,000 or less, for example, from about 2,000 to about 50,000, in embodiments, from about 3,000 to about 40,000, in embodiments, from about 10,000 to about 30,000, in embodiments, from about 15,000 to about 25,000, as determined by GPC using polystyrene standards. The low molecular weight amorphous polyester resins, available from commercial sources, may have an acid value of from about 8 to about 20 mg KOH/grams, in embodiments, from about 9 to about 16 mg KOH/grams, in embodiments, from about 10 to about 14 mg KOH/grams. The low molecular weight amorphous resins can possess an onset Tg of, for example, from about 40° C. to about 80° C., in embodiments, from about 50° C. to about 70° C., in embodiments, from about 58° C. to about 62° C., as measured by, for example, differential scanning calorimetry (DSC). The polymer(s) may be present in an amount of from about 65 to about 95% by weight, from about 75 to about 85% by weight of toner particles on a solids basis.

Suitable polyester resins include, for example, those which are sulfonated, non-sulfonated, crystalline, amorphous, combinations thereof and the like. The polyester resins may be linear, branched, crosslinked, combinations thereof and the like. Polyester resins may include those described, for example, in U.S. Pat. Nos. 6,593,049; 6,830,860; 7,754,406; 7,781,138; 7,749,672; and 6,756,176, the disclosures of which are hereby incorporated by reference in their entirety.

When a mixture is used, such as, amorphous and crystalline polyester resins, the ratio of crystalline polyester resin to amorphous polyester resin can be in the range from about 1:99 to about 30:70; from about 5:95 to about 25:75; in embodiments, from about 5:95 to about 15:95.

A polyester resin may be obtained synthetically, for example, in an esterification reaction involving a reagent comprising a carboxylic acid group and another reagent comprising an alcohol. In embodiments, the alcohol reagent comprises two or more hydroxyl groups, in embodiments, three or more hydroxyl groups. In embodiments, the acid comprises two or more carboxylic acid groups, in embodiments, three or more carboxylic acid groups. Reagents comprising three or more functional groups enable, promote or enable and promote polymer branching and crosslinking. In embodiments, a polymer backbone or a polymer branch comprises at least one monomer unit comprising at least one pendant group or side group, that is, the monomer reactant from which the unit was obtained comprises at least three functional groups.

Examples of polyacids or polyesters that can be used for preparing an amorphous polyester resin include terephthalic acid, phthalic acid, isophthalic acid, fumaric acid, trimellitic acid, diethyl fumarate, dimethyl itaconate, cis-1,4-diacetoxy-2-butene, dimethyl fumarate, diethyl maleate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanedioic acid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, naphthalene dicarboxylic acid, dimer diacid, dimethylfumarate, dimethylmaleate, dimethylglutarate, dimethyladipate, dimethyl dodecylsuccinate, and combinations thereof. The organic polyacid or polyester reagent may be present, for example, in an amount from about 40 to about 60 mole % of the resin, in embodiments from about 42 to about 52 mole % of the resin, in embodiments from about 45 to about 50 mole % of the resin, and optionally a second polyacid can be used in an amount from about 0.1 to about 10 mole % of the resin, from about 0.2 to about 8 mole % of the resin, from about 0.3 to about 6 mole % of the resin.

Examples of polyols which may be used in generating an amorphous polyester resin include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, dietylene glycol, bis(2-hydroxyethyl)oxide, dipropylene glycol, dibutylene glycol, and combinations thereof. The amount of organic polyol can vary, and may be present, for example, in an amount from about 40 to about 60 mole % of the resin, in embodiments from about 42 to about 55 mole % of the resin, in embodiments from about 45 to about 53 mole % of the resin, and a second polyol can be used in an amount from about 0.1 to about 10 mole %, in embodiments, from about 0.5 to about 8 mole %, from about 1 to about 4 mole % of the resin.

Polycondensation catalysts may be used in forming the amorphous (or crystalline) polyester resin, and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be used in amounts of, for example, from about 0.01 mole % to about 5 mole % based on the starting polyacid or polyester reagent(s) used to generate the polyester resin.

Examples of amorphous resins which may be used include alkali sulfonated-polyester resins, branched alkali sulfonated-polyester resins, alkali sulfonated-polyimide resins and branched alkali sulfonated-polyimide resins. Alkali sulfonated polyester resins may be useful in embodiments, such as, the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated-bisphenol-A-fumarate)-copoly(propoxylated bisphenol A-S-sulfo-isophthalate), copoly(ethoxylatedbisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, a lithium or a potassium ion.

In embodiments, an unsaturated amorphous polyester resin may be used as a latex resin. Examples of such resins include those disclosed in U.S. Pat. No. 6,063,827, the disclosure of which hereby is incorporated by reference in entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate) and combinations thereof.

In embodiments, a suitable amorphous resin may include alkoxylated bisphenol A fumarate/terephthalate-based polyester and copolyester resins. In embodiments, a suitable polyester resin may be an amorphous polyester resin, such as, a poly(propoxylated bisphenol A co-fumarate) resin. Examples of such resins and processes for production thereof include those disclosed in U.S. Pat. No. 6,063,827.

An example of a linear propoxylated bisphenol A fumarate resin is available under the trade name SPARII from Resana S/A Industrias Quimicas, Sao Paulo Brazil. Other propoxylated bisphenol A fumarate resins that are commercially available include GTUF and FPESL-2 from Kao Corporation, Japan, and EM181635 from Reichhold, Research Triangle Park, N.C., and the like.

For forming a crystalline polyester resin, suitable organic polyols include aliphatic polyols with from about 2 to about 36 carbon atoms, such as 1,2-ethanediol, 1,3-propanediol, 1,4-butanediol, 1,5-pentanediol, 2,2-ditnethylpropane-1,3-diol, 1,6-hexanediol, 1,7-heptane diol, 1,8-outanediol, 1,9-nonanediol, 1,10-decanediol, 1,12-dodecanediol and the like; alkali sulfo-aliphatic diols such as sodio-2-sulfo-1,2-ethanediol, lithio 2-sulfo-1,2-ethanediol, potassium-2-sulfo-1,2-ethanediol, sodio-2-sulfo-1,3-propanediol, lithio 2-sulfo-1,3-propanediol, potassio 2-sulfo-1,3-propanediol, mixture thereof, and the like, including their structural isomers. The aliphatic polyol may be, for example, selected in an amount from about 40 to about 60 mole %, in embodiments from about 42 to about 55 mole %, in embodiments from about 45 to about 53 mole %, and a second polyol can be used in an amount from about 0.1 to about 10 mole %, in embodiments, from about 0.3 to about 8 mole %, from about 1 to about 4 mole % of the resin.

Examples of organic polyacid or polyester reagents for preparing a crystalline resin include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid (sometimes referred to herein, in embodiments, as cyclohexanedioic acid), malonic acid and mesaconic acid, a polyester or anhydride thereof; and an alkali sulfo-organic polyacid, such as, the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomothoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sulfonate, or mixtures thereof. The organic polyacid may be selected in an amount of, for example, in embodiments from about 40 to about 60 mole %, in embodiments from about 42 to about 52 mole %, in embodiments from about 45 to about 50 mole %, and optionally, a second polyacid can be selected in an amount from about 0.1 to about 10 mole % of the resin, from about 0.3 to about 7 mole % of the resin, from about 0.5 to about 5 mole % of the resin.

Specific crystalline resins include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), polypropylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5 sulfoisophthaloyl)-copoly(hexylene-succinate), alkali copoly(5 sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly (ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentyl ene-adipate), alkali copoly(5-sulfo-isophthaloyl)-copoly(hexylene-adipaten-onylene-decanoate), poly(octylene-adipate), and so on, wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly (octylene-adipamide), poly(ethylene-succinimide), and poly (propylene-sebecamide). Examples of polyimides include poly(ethylene-adipimide), poly(propylene-adipimide), poly (butylene-adipimide), poly(pentylene-adipimide), poly (hexylene-adipimide), poly(octylene-adipimide), poly(ethylene-succinimide), poly(propylene-succinimide), and poly (butylene-succinimide).

Suitable crystalline resins which may be utilized, optionally in combination with an amorphous resin as described above, include those disclosed in U.S. Pub. No. 2006/0222991, the disclosure of which is hereby incorporated by reference in entirety.

In embodiments, a suitable crystalline resin may include a resin formed of ethylene glycol and a mixture of dodecanedioic acid and fumaric acid co-monomers. The crystalline resin may be present, for example, in an amount from about 1 to about 85% by weight of the toner components, in embodiments from about 2 to about 50% by weight of the toner components, in embodiments from about 5 to about 15% by weight of the toner components. The crystalline resin can possess various melting points of, for example, from about 30° C. to about 120° C., in embodiments, from about 50° C. to about 90° C., in embodiments, from about 60° C. to about 80° C.

The crystalline resin may have a number average molecular weight (Mn), of, for example, from about 1,000 to about 50,000, in embodiments from about 2,000 to about 25,000, and an MW of, for example, from about 2,000 to about 100,000, in embodiments from about 3,000 to about 80,000. The molecular weight distribution (M,/Mn or PD) of the crystalline resin may be, for example, from about 2 to about 6, in embodiments, from about 3 to about 4.

Condensation catalysts which may be used in the polyester reaction include tetraalkyl titanates; dialkyltin oxides, such as, dibutyltin oxide; tetraalkyltins, such as, dibutyltin dilaurate; dibutyltin diacetate; dibutyltin oxide; dialkyltin oxide hydroxides, such as, butyltin oxide hydroxide; aluminum alkoxides, alkyl zinc, dialkyl zinc, zinc oxide, stannous oxide, stannous chloride, butylstannoic acid, or combinations thereof. Such catalysts may be used in amounts of, for example, from about 0.01 mole % to about 5 mole % based on the amount of starting polyacid, polyol or polyester reagent in the reaction mixture.

Generally, as known in the art, the polyacid/polyester and polyols reagents are mixed together, optionally with a catalyst, and incubated at an elevated temperature, such as, from about 180° C. or more, from about 190° C. or more, from about 200° C. or more and so on, which can be conducted anaerobically, to enable esterification to occur until equilibrium, which generally yields water or an alcohol, such as, methanol, arising from forming the ester bonds in esterification reactions. The reaction can be conducted under vacuum to promote polymerization. The product is collected by practicing known methods, and can be dried, again, by practicing known methods to yield particulates.

Branching agents can be used, and include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, 1,2,7,8-octanetetracarboxylic acid, acid anhydrides thereof, lower alkyl esters thereof and so on. The branching agent can be used in an amount from about 0.01 to about 10 mole % of the resin, from about 0.05 to about 8 mole %, from about 0.1 to about 5 mole % of the resin.

In embodiments, non-polyester resins may be used in a latex. Suitable examples of non-polyester toner latex resins or polymers may include non-crosslinked resin and crosslinked resin or gel combinations including, but not limited to, styrene acrylates, styrene methacrylates, butadienes, isoprene, acrylonitrile, acrylic acid, methacrylic acid, beta-carboxy ethyl acrylate, polyesters, polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. In some embodiments, the resin or polymer is a styrene/butyl acrylate/carboxylic acid terpolymer. In some embodiments, at least one of the resins is substantially free of crosslinking and the crosslinked resin comprises carboxylic acid in an amount of about 0.05 to about 10 weight percent based upon the total weight of the resin substantially free of crosslinking or crosslinked resin.

In some embodiments, the resin used in forming the toner particles can be one type of resin, or a mixture or combination of two or more types of resins. For example, a single resin (non-crosslinked or crosslinked) can be used to form the toner particles. Alternatively the toner particles can be formed by using a mixture of two or more resins, which are added together or separately, at the same time or not, during the toner particle formation process. In some embodiments, the resin used comprises two resins, one of which is non-crosslinked and the other of which is crosslinked.

In embodiments, the resin that is substantially free of crosslinking (also referred to herein as a non-crosslinked resin) comprises a resin having less than about 0.1 percent crosslinking. For example, the non-crosslinked latex comprises in some embodiments styrene, butylacrylate, and beta-carboxyethylacrylate (beta-CEA) monomers, although not limited to these monomers. Resin particles may be formed de novo by emulsion polymerization in the presence of an initiator, a chain transfer agent (CTA), and surfactant.

In some embodiments, the resin substantially free of crosslinking comprises styrene:butylacrylate:beta-carboxy ethylacrylate wherein, for example, the non-crosslinked resin monomers are present in an amount from about 70% to about 90% styrene, about 10% to about 30% butylacrylate, and about 0.05 parts per hundred to about 10 parts per hundred beta-CEA, or about 3 parts per hundred beta-CEA, by weight based upon the total weight of the monomers, although not so limited. Other acrylate-based resins may comprise, without limitation, acrylic acid, methacrylic acid, itaconic acid, beta carboxyethyl acrylate (beta CEA), fumaric acid, maleic acid, and cinnamic acid.

In particular embodiments, the non-crosslinked resin may comprise about 73% to about 85% styrene, about 27% to about 15% butylacrylate, and about 1.0 part per hundred to about 5 parts per hundred beta-CEA, by weight based upon the total weight of the monomers although the compositions and processes are not limited to these particular types of monomers or ranges. In other embodiments, the non-crosslinked resin may comprise about 81.7% styrene, about 18.3% butylacrylate and about 3.0 parts per hundred beta-CEA by weight based upon the total weight of the monomers.

Emulsion polymerization initiators may include, without limitation, sodium, potassium or ammonium persulfate and may be present in the range of, for example, about 0.5 to about 3.0 percent based upon the weight of the monomers, although not limited. The CTA may be present in an amount of from about 0.5 to about 5.0 percent by weight based upon the combined weight of the monomers, although it is not so limited. In some embodiments, the surfactant may comprise an anionic surfactant present in the range of about 0.7 to about 5.0 percent by weight based upon the weight of the aqueous phase, although it is not limited to this type or range.

By way of example, the monomers may be polymerized under starve fed conditions as disclosed in U.S. Pat. Nos. 6,447,974, 6,576,389, 6,617,092, and 6,664,017, which are hereby incorporated by reference herein in their entireties, to provide latex resin particles having a diameter in a range from about 100 to about 300 nanometers. In some embodiments, the molecular weight of the non-crosslinked latex resin may be in a range from about 30,000 to about 37,000, or up to about 34,000, although it is not limited to this range.

In some embodiments, the onset glass transition temperature (Tg) of the non-crosslinked resin may be in the range from about 46° C. to about 62° C., or about 58° C., although it is not so limited. In some embodiments, the amount of acrylate-based monomers may be in a range of from about 0.04 to about 4.0 ppb of the resin monomers, although it is not so limited. In some embodiments, the number average molecular weight (Mn) may be in a range of from about 5000 to about 20,000, or about 11,000 daltons. In some embodiments, the prepared non-crosslinked latex resin has a pH of about 1.0 to about 4.0, or about 2.0.

In some embodiments, a crosslinked latex is prepared from a non-crosslinked latex comprising styrene, butylacrylate, beta-CEA, and divinyl benzene, by emulsion polymerization, in the presence of an initiator such as a persulfate, a CTA, and a surfactant. In some embodiments, the crosslinked resin monomers may be present in a ratio of about 60% to about 75% styrene, about 40% to about 25% butylacrylate, about 3 parts per hundred to about 5 parts per hundred beta-CEA, and about 3 parts per hundred to about 5 parts per hundred divinyl benzene, although not it is not so limited to these particular types of monomers or ranges. Any of the above-described monomers can also be used for forming the crosslinked latex or gel, as desired.

In some embodiments, the monomer composition may comprise, for example, about 65% styrene, 35% butylacrylate, 3 parts per hundred beta-CEA, and about 1 parts per hundred divinyl benzene, although the composition is not limited to these amounts. In some embodiments, the Tg (onset) of the crosslinked latex may be in a range of from about 40° C. to about 55° C., or about 42° C.

In some embodiments, the degree of crosslinking may be in a range of from about 0.3 percent to about 20 percent, although it is not so limited thereto, since an increase in the divinyl benzene concentration may increase the crosslinking.

In some embodiments, a soluble portion of the crosslinked latex may have a weight average molecular weight (Mw) of about 135,000 and a number average molecular weight (Mn) of about 27,000, but it is not so limited thereto.

In some embodiments, the particle diameter size of the crosslinked latex may be in a range of from about 20 to about 250 nanometers, or about 50 nanometers, although it is not so limited.

In some embodiments, the surfactant may be any surfactant, such as for example a nonionic surfactant or an anionic surfactant, such as, but not limited to, Neogen RK or Dowfax, both of which are commercially available. In some embodiments, the pH may be in a range of from about 1.5 to about 3.0, or about 1.8.

In some embodiments, the latex particle size can be, for example, from about 0.05 micron to about 1 micron in average volume diameter as measured by the Brookhaven nanosize particle analyzer. Other sizes and effective amounts of latex particles may be selected in some embodiments.

The latex resins selected for forming toner particles may be prepared, for example, by emulsion polymerization methods, and the monomers utilized in such processes may include the monomers listed above, such as, styrene, acrylates, methacrylates, butadiene, isoprene, acrylonitrile, acrylic acid, and methacrylic acid, and beta CEA. Known chain transfer agents, for example dodecanethiol, in effective amounts of, for example, from about 0.1 to about 10 percent, and/or carbon tetrabromide in effective amounts of from about 0.1 to about 10 percent, can also be employed to control the resin molecular weight during the polymerization.

Other processes for obtaining resin particles of from, for example, about 0.05 micron to about 1 micron can be selected from polymer microsuspension process, such as the processes disclosed in U.S. Pat. No. 3,674,736, the disclosure of which is incorporated herein by reference in its entirety, polymer solution microsuspension processes, such as disclosed in U.S. Pat. No. 5,290,654, the disclosure of which is incorporated herein by reference in its entirety, mechanical grinding or milling processes, or other known processes.

In embodiments, the resin may be a crosslinked or a crosslinkable resin. A suitable resin conducive to crosslinking is one with a reactive group, such as, a C═C bond or with pendant or side groups, such as, a carboxylic acid group. The resin can be crosslinked, for example, through free radical polymerization with an initiator. Suitable initiators include peroxides such as, organic peroxides or azo compounds, for example diacyl peroxides, such as, decanoyl peroxide, lauroyl peroxide and benzoyl peroxide, ketone peroxides, such as, cyclohexanone peroxide and methyl ethyl ketone, alkyl peroxy esters, such as, t-butyl peroxy neodecanoate, 2,5-dimethyl 2,5-di(2-ethyl hexanoyl peroxy)hexane, tamyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, alkyl peroxides, such as, dicumyl peroxide, 2,5-dimethyl 2,5-di(t-butyl peroxy)hexane, t-butyl cumyl peroxide, bis(t-butyl peroxy)diisopropyl benzene, di-t-butyl peroxide and 2,5-dimethyl 2,5-di(t-butyl peroxy)hexyne-3, alkyl hydroperoxides, such as, 2,5-dihydro peroxy 2,5-dimethyl hexane, cumene hydroperoxide, t-butyl hydroperoxide and t-amyl hydroperoxide, and alkyl peroxyketals, such as, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-di(t-butyl peroxy)butyrate and ethyl 3,3-di(t-amyl peroxy)butyrate, azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), 1,1-di(t-butyl peroxy)-3,3,5-trimethylcyclohexane, combinations thereof and the like. The amount of initiator used is proportional to the degree of crosslinking, and thus, the gel content of the polyester material. The amount of initiator used may range from, for example, about 0.01 to about 10 weight %, from about 0.1 to about 5 weight % of the polyester resin. In the crosslinking, it is desirable that substantially all of the initiator be consumed. The crosslinking may be carried out at high temperature, and thus the reaction may be very fast, for example, less than 10 minutes, such as from about 20 seconds to about 2 minutes residence time. The polymer reagent then can be incorporated with, for example, other reagents suitable for making a toner particle, such as, a colorant and/or a wax, and processed in a known manner to produce toner particles.

Waxes

In some embodiments, toner compositions may comprise a wax. Suitable waxes for the present toner compositions include, but are not limited to, alkylene waxes such as alkylene wax having about 1 to about 25 carbon atoms, polyethylene, polypropylene or mixtures thereof. The wax is present, for example, in an amount of about 6% to about 15% by weight based upon the total weight of the composition. Examples of waxes include those as illustrated herein, such as those of the aforementioned co-pending applications, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes possess, it is believed, a molecular weight (Mw) of about 1,000 to about 5,000, and the commercially available polypropylenes are believed to possess a molecular weight of about 4,000 to about 10,000. Examples of functionalized waxes include amines, amides, for example Aqua SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 41™, AQUA POLYSILK 19™, POLYSILK 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson Wax.

In some embodiments, the wax comprises a wax in the form of a dispersion comprising, for example, a wax having a particle diameter of about 100 nanometers to about 500 nanometers, water, and an anionic surfactant. In embodiments, the wax is included in amounts such as about 6 to about 15 weight percent. In embodiments, the wax comprises polyethylene wax particles, such as Polywax 850, commercially available from Baker Petrolite, although not limited thereto, having a particle diameter in the range of about 100 to about 500 nanometers, although not limited. The surfactant used to disperse the wax is an anionic surfactant, although not limited thereto, such as, for example, NEOGEN RK™ commercially available from Kao Corporation or TAYCAPOWER BN2060 commercially available from Tayca Corporation.

Colorants

In embodiments, methods disclosed herein may include an aggregation mixture comprising a colorant. In some such embodiments, the colorant may be present in amount conferring the toner particles with hyperpigmentation. As used herein, "hyperpigmented" means a toner having high pigment loading at low toner mass per unit area (TMA), for example, such toners may have an increased in pigment loading of at least about 25%, at least about 35%, at least about 45%, at least about 55% or more relative to non-hyperpigmented toners (e.g., toners having carbon black pigment loadings of 6% or lower). In embodiments, a hyperpigmented toner as used herein is any new formulation wherein the amount of pigment is at least about 1.2 times that found in a control or known toner, in embodiments, at least about 1.3 times, at least about 1.4 times, at least about 1.5 times or more pigment as found in control or known formulation. In embodiments, hyperpigmented comprises greater than about 7%, greater than about 8%, greater than about 9% pigment of the total toner particle dry weight.

In some embodiments, the colorant may be disposed in super-fine toners (i.e., about 3.8 micron toner particles).

Suitable colorants include those comprising carbon black, such as, REGAL 330® and Nipex 35; magnetites, such as, Mobay magnetites, M08029™ and M08060™; Columbian magnetites, MAPICO® BLACK; surface-treated magnetites; Pfizer magnetites, CB4799™, CB5300™, CB5600™ and MCX6369™; Bayer magnetites, BAYFERROX™ 8600 and 8610; Northern Pigments magnetites, NP604™ and NP-608™; Magnox magnetites, TMB-100™ or TMB104™; and the like.

Colored pigments, such as, cyan, magenta, yellow, red, orange, green, brown, blue or mixtures thereof can be used. The additional pigment or pigments can be used as water-based pigment dispersions. Some colorants are conductive, that is, carry, conduct, transmit an electric charge, such as, some black colorants.

Examples of pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, PYLAM OIL YELLOW™ and PIGMENT BLUE I™ available from Paul Uhlich & Company, Inc.; PIGMENT VIOLET I™, PIGMENT RED 48TH, LEMON CHROME YELLOW DCC 1O26™, TOLUIDINE RED™ and BON RED C™ available from Dominion Color Corporation, Ltd., Toronto, Ontario; NOVAPERM YELLOW FGL™ and HOSTAPERM PINK E™ from Hoechst; CINQUASIA MAGENTA™ available from E.I. DuPont de Nemours & Co., and the like.

Examples of magenta pigments include 2,9-dimethyl-substituted quinacridone, an anthraquinone dye identified in the Color Index as CI-60710, CI Dispersed Red 15, a diazo dye identified in the Color Index as CI-26050, CI Solvent Red 19, and the like.

Illustrative examples of cyan pigments include copper tetra (octadecylsulfonamido) phthalocyanine, a copper phthalocyanine pigment listed in the Color Index as CT 74160, CT Pigment Blue, Pigment Blue 15:3, Pigment Blue 15:4, an Anthrazine Blue identified in the Color Index as CI-69810, Special Blue X-2137, and the like.

Illustrative examples of yellow pigments are diarylide yellow 3,3-dichlorobenzidene acetoacetanilide, a monoazo pigment identified in the Color Index as CI-12700, CI Solvent Yellow 16, a nitrophenyl amine sulfonamide identified in the Color Index as Foron Yellow SE/GLN, CI Disperse Yellow 3, 2,5-dimethoxy-4-sulfonanilide phenylazo-4'-chloro-2,5-dimethoxy acetoacetanilide and Permanent Yellow FGL.

Other known colorants can be used, such as, Levanyl Black ASF (Miles, Bayer) and Sunsperse Carbon Black LHD 9303 (Sun Chemicals), and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), SUCD-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like. Other pigments that can be used, and which are commercially available include various pigments in the color classes, Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7 and so on, and combinations thereof.

The colorant, for example furnace carbon black, cyan, magenta and/or yellow colorant, may be incorporated in an amount sufficient to impart the desired color to the toner. In general, pigment or dye, may be employed in an amount ranging from about 2% to about 50% by weight of the toner particles on a solids basis, from about 5% to about 40% by weight, from about 7% to about 30% by weight.

In embodiments, more than one colorant may be present in a toner particle. For example, two colorants may be present in a toner particle, such as, a first colorant of pigment blue, may be present in an amount ranging from about 2% to about 10% by weight of the toner particle on a solids basis, from about 3% to about 8% by weight, from about 5% to about 10% by weight; with a second colorant of pigment yellow that may be present in an amount ranging from about 5% to about 20% by weight of the toner particle on a solids basis, from about 6% to about 15% by weight, from about 10% to about 20% by weight and so on.

Surfactants

In some embodiments, toner particles disclosed herein may be formed in the presence of surfactants. For example, surfactants may be present in a range of from about 0.01 to about 20, or about 0.1 to about 15 weight percent of the reaction mixture. Suitable surfactants include, for example, nonionic surfactants such as dialkylphenoxypoly-(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ In some embodiments, an effective concentration of the nonionic surfactant may be in a range of from about 0.01 percent to about 10 percent by weight, or about 0.1 percent to about 5 percent by weight of the reaction mixture.

Suitable anionic surfactants may include, without limitation sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™, available from Kao, Dowfax 2A1 (hexa decyldiphenyloxide disulfonate) and the like, among others. For example, an effective concentration of the anionic surfactant generally employed is, for example, about 0.01 percent to about 10 percent by weight, or about 0.1 percent to about 5 percent by weight of the reaction mixture In some embodiments, anionic surfactants may be used in conjunction with bases to modulate the pH and hence ionize the aggregate particles thereby providing stability and preventing the aggregates from growing in size. Such bases can be selected from sodium hydroxide, potassium hydroxide, ammonium hydroxide, cesium hydroxide and the like, among others.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX890™ and ANTAROX897. For example, an effective amount of the anionic or nonionic surfactant generally employed as an aggregate size stabilization agent is, for example, about 0.01 percent to about 10 percent or about 0.1 percent to about 5 percent, by weight of the reaction mixture.

In some embodiments acids that may be utilized in conjunction with surfactants to modulate pH. Acid may include, for example, nitric acid, sulfuric acid, hydrochloric acid, acetic acid, citric acid, trifluoroacetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Charge Control Agent

The toner may include any known charge additives in amounts of from about 0.1 to about 10 weight %, in embodiments, of from about 0.5 to about 7 weight % of the toner. Examples of such charge additives include alkyl pyridinium halides, bisulfates, the charge control additives of U.S. Pat. Nos. 3,944,493; 4,007,293; 4,079,014; 4,394,430; and 4,560,635, the disclosure of each of which hereby is incorporated by reference in entirety, negative charge enhancing additives, such as, aluminum complexes, and the like.

Charge enhancing molecules can be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, cetyl pyridinium tetrafluoroborates, distearyl dimethyl ammonium methyl sulfate, aluminum salts and so on.

Such enhancing molecules can be present in an amount of from about 0.1 to about 10%, from about 1 to about 3% by weight.

Additives

Other additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98, or about 0.97.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLE

This Example shows the effects of temperature and heating method (jacket vs. cascade control) on cycle times and toner particle properties.

General procedure: A reactor was charged with deionized water, core polyester latex resins, pigment, wax, and a flocculant. The batch was initiated by adding 0.3M $HNO_3$ to reduce the pH to 4.20 and the mixture homogenized. Following homogenization, the mixture was heated to about 48° C. to initiate aggregation with a target $D_{50V}$ of about 4.8 to about 5.0 microns. A shell latex was added to a target $D_{50V}$ of 5.8 to about 6.0 microns. The reaction was stopped by addition of sodium hydroxide and a chelating agent. Then, the temperature was adjusted to the target coalescence temperature via direct jacket controlled heating. Coalescence was continued until a circularity of about 0.970 was achieved.

Comparative runs at 85° C. and 75° C. were conducted on a 20-gallon scale for black EA toner particles. Data was obtained via jacket controlled heating. Circularity time (i.e., coalescence time), particle size distribution (D84/50), and average circularity are summarized in Table 1. Each entry represents an average of at least three data points.

TABLE 1

| Temp (° C.) | Circularity Time (min) | D84/50 | Avg Circularity |
|---|---|---|---|
| 85 | 90 | 1.201 | 0.971 |
| 75 | 120 | 1.2 | 0.970 |

On pilot scale, it was observed that the desired circularity at lower temperature could be achieved with the same or lower overall cycle time (i.e., ramping time plus coalescence time). Thus, the time difference in overall cycle time at lower temperature appears to be a benefit afforded by the reduction in ramping time to achieve the lower target temperature (75° C.).

In a typical process, cascade control heating may be used to reach from 82° C. to 85° C. This type of control reacts to the overall batch temperature and forces the heating jacket to vary significantly from high temperatures, even in excess of 105° C., to reach the batch temperature quickly. This has been indicated graphically in the plot of FIG. 2 for a pilot scale run. By lowering the overall temperature to 75° C., and employing a jacket control heating by maintaining the jacket at 85° C. during ramping and then lowering the jacket temperature to 75° C. after the batch temperature has reached the target temperature of 75° C., a consistent temperature profile was achieved.

Employing jacket-controlled heating in lieu of cascade control also decreased the overall coarse particles being generated as indicated in Table 2 below. As indicated in Table 2, over the course of coalescence run, the jacket control batch showed no coarse generation, while the cascade batch had to be stopped due to uncontrollable coarse generation as indicated by the increased D84/50 ratio.

TABLE 2

| | D84/50 | |
|---|---|---|
| Time | Cascade control | Jacket control |
| 0 Min | 1.184 | 1.207 |
| 30 Min | 1.188 | 1.201 |
| 60 Min | 1.268 | 1.205 |
| 90 Min | 1.403 | 1.198 |

Moreover, the lower coalescence temperature coupled with jacket-controlled heating also improved the dielectric loss characteristics for black toner. Table 3 shows the improvement in dielectric loss for hyper-pigmented toner particles with jacket temperature control compared to cascade control at 75° C.

TABLE 3

| Particle Batch | Heat Control Method | E" * 1000 (loss) |
|---|---|---|
| 1 | Cascade | 97 |
| 2 | Cascade | 78 |
| 3 | Cascade | 65 |
| 4 | Cascade | 74 |

TABLE 3-continued

| Particle Batch | Heat Control Method | E" * 1000 (loss) |
|---|---|---|
| 5 | Jacket | 46 |
| 6 | Jacket | 46 |
| 7 | Jacket | 51 |

E"*1000 values below 65 are generally desired for good toner performance. Table 3 indicates that the pilot-scale toners run on jacket control were significantly below this limit, while cascade-controlled batches exhibited much higher dielectric loss.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A method of forming toner particles comprising:

aggregating a mixture comprising a latex, a wax, and an optional pigment to form pre-toner particles; and coalescing the pre-toner particles at a substantially constant target temperature selected within a range from about the glass transition temperature of the pre-toner particles to about 75° C., thereby creating toner particles having a substantially constant particle size distribution during the coalescing step, wherein the substantially constant target temperature is achieved by direct jacket controlled heating.

2. The method of claim 1, further comprising adding a shell latex to the pre-toner particles before or during the coalescing step, thereby creating shell-core toner particles.

3. The method of claim 1, wherein the mixture includes a colorant.

4. The method of claim 1, wherein the toner particles are hyperpigmented.

5. The method of claim 1, wherein the toner particles are super-fine.

6. The method of claim 1, wherein the toner particles exhibit reduced coarse particle formation during the coalescing step as indicated by a substantially constant $D_{50}$-$D_{84}$ ratio over the period of coalescence.

7. The method of claim 1, wherein the toner particles exhibit a dielectric loss of less than about 60 J/s.

8. A method of forming toner particles comprising:

aggregating a latex, a wax, and a colorant to form pre-toner particles; and coalescing the pre-toner particles at a substantially constant target temperature in a range from about the glass transition temperature of the pre-toner particles to about 75° C., thereby creating toner particles, wherein the toner particles exhibit reduced coarse particle formation during the coalescing step and have a substantially constant $D_{50}$-$D_{84}$ ratio over the period of coalescence, and wherein the toner particles exhibit a dielectric loss of less than about 60 J/s.

9. The method of claim 8, the substantially constant target temperature is achieved by direct jacket controlled heating.

10. The method of claim 8, further comprising adding a shell latex to the pre-toner particles before or during the coalescing step, thereby forming shell-core toner particles.

11. The method of claim 8, wherein the toner particles are hyperpigmented.

12. The method of claim 8, wherein the toner particles are super-fine.

13. A method comprising:

aggregating a latex, a wax, and a colorant to form pre-toner particles; and coalescing the pre-toner particles at a substantially constant target temperature in a range from about the glass transition temperature of the pre-toner particles to about 75° C., thereby creating toner particles, wherein the toner particles are hyperpigmented and exhibit a dielectric loss of less than about 60 J/s.

14. The method of claim 13, wherein the substantially constant target temperature is maintained via direct jacket-controlled heating.

15. The method of claim 13, further comprising adding a shell latex to the pre-toner particles during the coalescing step.

16. The method of claim 13, wherein the toner particles are super-fine.

17. The method of claim 13, wherein the dielectric loss is less than about 50 J/s.

* * * * *